US007934776B2

(12) United States Patent
de Andrade et al.

(10) Patent No.: US 7,934,776 B2
(45) Date of Patent: May 3, 2011

(54) MINING MACHINE WITH DRIVEN DISC CUTTERS

(75) Inventors: Alex Freire de Andrade, Johannesburg (ZA); Charl Christo Veldman, Pretoria (ZA); Arthur Kenneth Möller, Pretoria (ZA); Joaquim Antonio Soares de Sousa, Brackendowns (ZA); Theuns Fichardt Skea, Centurion (ZA)

(73) Assignee: Joy MM Delaware, Inc., Wilmington, DE (US)

( * ) Notice: Subject to any disclaimer, the term of this patent is extended or adjusted under 35 U.S.C. 154(b) by 219 days.

(21) Appl. No.: 11/849,262

(22) Filed: Aug. 31, 2007

(65) Prior Publication Data

US 2009/0058172 A1 Mar. 5, 2009

(51) Int. Cl.
*E21C 31/10* (2006.01)

(52) U.S. Cl. ..... 299/75; 299/14

(58) Field of Classification Search ..... 299/73, 299/74, 75, 76, 77, 78, 14
See application file for complete search history.

(56) References Cited

U.S. PATENT DOCUMENTS

| | | | | |
|---|---|---|---|---|
| 4,273,383 | A * | 6/1981 | Grisebach | 299/23 |
| 6,561,590 | B2 * | 5/2003 | Sugden | 299/71 |
| 6,857,706 | B2 | 2/2005 | Hames et al. | |
| 7,695,071 | B2 | 4/2010 | Jackson et al. | |

FOREIGN PATENT DOCUMENTS

| | | |
|---|---|---|
| AU | 466244 B1 | 2/1972 |
| WO | 0043637 | 7/2000 |

OTHER PUBLICATIONS

Office Action cited in Austrian Patent Application No. 1344/2008, dated Feb. 4, 2011, 6 pages.

* cited by examiner

*Primary Examiner* — John Kreck
(74) *Attorney, Agent, or Firm* — Michael Best & Friedrich LLP

(57) ABSTRACT

A mining machine includes a cutting mechanism with an arm, and a substantial weight of more than a thousand pounds attached to the arm. The mining machine also includes a first disc cutter adapted to engage the material to be mined and mounted on a first disc cutter assembly for eccentrically driving the first disc cutter, the first disc cutter assembly being mounted within the substantial weight. The mining machine also includes at least a second disc cutter spaced apart from the first disc cutter assembly and adapted to engage the material to be mined, and mounted on a second disc cutter assembly for eccentrically driving the second disc cutter, the second disc cutter assembly being mounted within the substantial weight.

4 Claims, 10 Drawing Sheets

MINING MACHINE WITH DRIVEN DISC CUTTERS

BACKGROUND OF THE INVENTION

The present invention relates to a mining machine and is particularly, although not exclusively, concerned with excavating hard rock.

Traditionally, excavation of hard rock in the mining and construction industries, has taken one of either two forms, namely explosive excavation, or rolling edge disc cutter excavation. Explosive mining entails drilling a pattern of holes of relatively small diameter into the rock being excavated, and loading those holes with explosives. The explosives are then detonated in a sequence designed to fragment the required volume of rock for subsequent removal by suitable loading and transport equipment. The explosives are detonated once all personnel are evacuated from the excavation site and the explosive process is repeated cyclically, until the required excavation is complete.

The cyclical nature of the process and the violent nature of the rock fragmentation have to date prevented automation of the explosive process, so that the modern requirement for continuous operation and increased production efficiency has not been met. Moreover, the relatively unpredictable size distribution of the rock product formed complicates downstream processing.

Mechanical fragmentation of rock eliminates the use of explosives, has already been achieved and is well known through the use of rolling edge-type disc cutter technology. This technology has facilitated automation of the excavation process including the benefit of remotely controlled excavation machinery. However, rolling edge cutters require the application of very large forces to crush and fragment the rock under excavation. For example, the average force required per cutter is about 50 tones and typically, peak forces experienced by each cutter are more than twice than this. It is common for multiple cutters to be arranged to traverse the rock in closely spaced parallel paths, and 50 cutters per cutting array is common. Cutting machinery of this kind can weigh upwards of 800 tones, thereby requiring electrical power in the order of thousands of kilowatts for operation. As such, the machinery can only be economically employed on large projects, such as water and power supply tunnels. Additionally, the excavation carried out by such machinery is generally limited to a cross-section that is commonly circular.

Sugden U.S. Pat. No. 6,561,590 issued May 13, 2003, describes a cutting device that alleviates one or more of the disadvantages associated with prior art cutting devices. It is such a device (called the Sugden device) that is utilized in the herein later described invention. The Sugden device is a cutting device of a rotary (disc) undercutting type, that provides improved rock removal from a rock face and which is relatively economical to manufacture and operate.

The Sugden device employs a reaction mass of sufficient magnitude to absorb the forces applied to the rock by the disc cutter during each cycle of oscillation, with minimum or minor displacement of the device, or the structure supporting the device. Because the device usually applies a load at an angle to the rock face, it causes tensile fracture of the rock, instead of crushing the rock. This tensile fracture force applied to the rock is substantially less than that needed with crushing forces, such that a corresponding reduction in the required reaction mass compared to known rock excavation machinery can also be adopted. The Sugden device disc cutter when mounted to a support structure is preferably arranged so that the reaction mass can absorb the cyclic and peak forces experienced by the disc cutter, while the support structure provides a restoring force compared to the average force experienced by the disc cutter.

The Sugden device typically requires substantially reduced applied forces relative to known rock excavating machinery. A reduction at least in respect of normal forces, an order of magnitude or some other significant fraction, is envisaged. Such low forces facilitate the use of a support structure in the form of an arm or boom, which can force the edge of the disc cutter into contact with the rock at any required angle and to manipulate the position of the disc cutter in any direction. In particular, in relation to longwall mining, the disc cutter, or array of disc cutters, may be mounted to traverse the length of the long wall face and to be advanced in the main mining direction at each pass. Advantageously, the Sugden device provides for entry of the disc cutter into the rock face from either a previously excavated drive in a longwall excavation, or from pre-bored access holes, or by attacking the rock at a shallow angle to the face until the required depth for the pass is achieved. With the disc cutter mounted on a movable boom, the disc cutter can be moved about the rock face to excavate that face at any desired geometry.

The Sugden U.S. Pat. No. 6,561,590 also discloses that its cutting device is not restricted to a single disc cutter, but can include more than one. For example, the cutting device may include three disc cutters arranged along the same plane, but angled at approximately 45 degree to each other. Such an arrangement can produce a cut face of a particular shape, while the speed at which rock is removed is greatly increased. In this arrangement, each of the three disc cutters is driven by separate drive means. The use of multiple disc cutters is particularly useful for longwall operations.

The Sugden U.S. Pat. No. 6,561,590 also discloses that the cutting device is suitable for a range of cutting and mining operations and machinery, such as longwall mining, mobile mining machines, tunneling machines, raise borers, shaft sinkers and hard rock excavation generally.

SUMMARY OF THE INVENTION

It is an object of the invention to provide a mining machine that can effectively use an eccentrically driven disc to mine materials.

The invention is a mining machine including a cutting mechanism comprising an arm, a substantial weight of more than a thousand pounds attached to the arm, and a first disc cutter adapted to engage the material to be mined and mounted on a first disc cutter assembly for eccentrically driving the first disc cutter. The first disc cutter assembly is mounted within the substantial weight. The mining machine also includes a second disc cutter spaced apart from the first disc cutter assembly and adapted to engage the material to be mined and mounted on a second disc cutter assembly for eccentrically driving the second disc cutter, the second disc cutter assembly being mounted within the substantial weight.

The invention also provides such a mining machine with the first disc cutter being driven about an axis that is at an angle to the arm longitudinal axis, and the second disc cutter being driven about an axis that is parallel to the arm longitudinal axis. The mining machine also includes a third disc cutter adapted to engage the material to be mined and mounted on the arm end spaced apart from the second disc cutter by a third disc cutter assembly for eccentrically driving the third disc cutter, the third disc cutter being mounted to rotate about an axis that is at an angle to the arm longitudinal axis and at an angle to the first disc cutter axis.

The invention also provides such a mining machine with the three disc cutters having a cutting axis that when drawn through the three disc cutters is perpendicular to the arm longitudinal axis, the three disc cutters being spaced apart along the cutting axis, and the cutting axis being offset from a line drawn perpendicular to the mine floor. The invention also provides such a mining machine with the three disc cutter cutting equal depths into the material to be mined. The invention also provides such a mining machine including means to determine a change in the rate of any rotation of the disc cutter.

The invention also provides such a mining machine including a forward platform, a rearward platform, extendable and retractable means between the forward platform and the rearward platform, and means for anchoring the rearward platform or forward platform, the means comprising drills that are extended into the mine floor. Additionally, hydraulic or mechanical machine mounted props can also be used at various locations between the mine floor and the mine roof.

The invention also provides a method of operating a mining machine including an arm, a cutter mounted on the arm, means for mounting the arm for swinging side to side movement on the forward platform, and means to swing the arm from side to side, the method comprising the steps of: advancing the arm toward the material to be mined a first incremental distance, swinging the arm to cut the material, and then advancing the arm toward the material to be mined a second incremental distance, the second incremental distance being greater than the first incremental distance.

The invention also provides such a mining machine including means for mounting the arm for swinging horizontal side to side movement on the forward platform, the mounting means including pivot means for vertical top to bottom movement of the arm, the pivot means including a split support pin, the split support pin including a top pin and a bottom pin, an upper spherical bearing housing receiving the top pin, a lower spherical bearing housing receiving the bottom pin, an upper spherical bearing between the upper spherical bearing housing and the support pin, and a lower spherical bearing between the lower spherical bearing housing and the support pin. And wherein the pivot means includes a lever attached to the lower spherical bearing housing. The device of the invention can operate to cut or excavate very hard rock, with greatly reduced applied force and a substantially increased output rate per disc cutter, while using less power per unit volume of rock removed.

Figure 1:
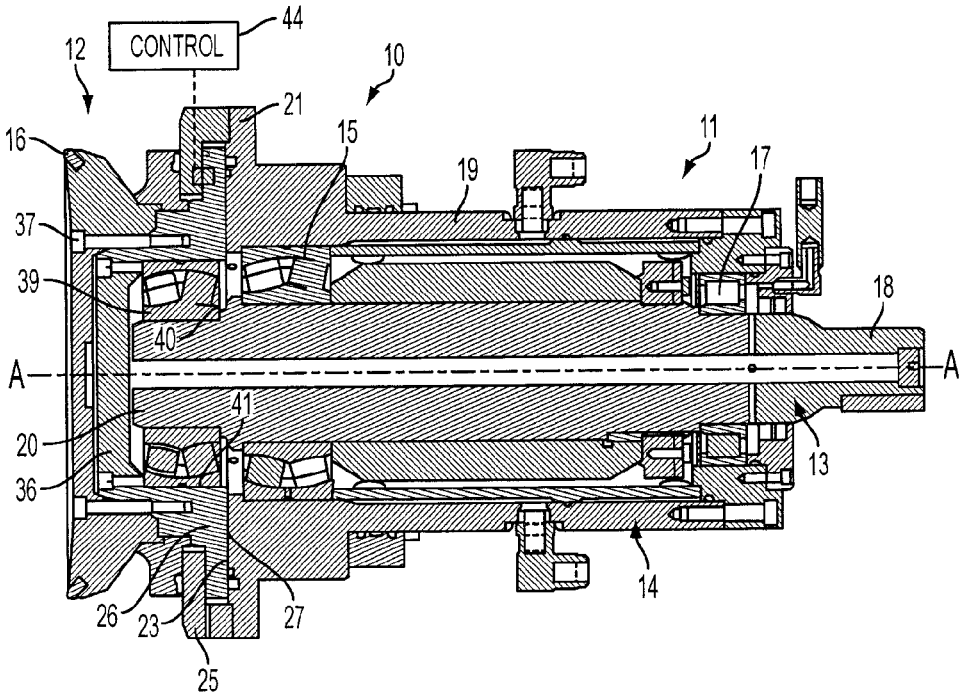
FIG. 1 is a cross-sectional view of a disc cutter assembly.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENT

FIG. 1 is a cross-sectional view of a disc cutter assembly. The disc cutter assembly 10 includes a mounting assembly 11 and a rotary disc cutter 12. The mounting assembly 11 includes a mounting shaft 13 which is rotatably mounted within a housing 14, that can constitute or be connected to a large mass for impact absorption. The housing 14 thus, can be formed of heavy metal or can be connected to a heavy metallic mass. The mounting shaft includes a shaft drive section 18 and a disc drive section 20.

A rock excavating or mining machine according to the present invention includes the disc cutter 12, and is characterized in that the disc cutter is driven to move in an eccentric manner. The magnitude of eccentric movement is directly proportional to the amount of offset between the disc drive section axis and the center of the shaft drive section axis and generally that amount is relatively small. Preferably, the disc cutter 12 is caused to be driven eccentrically through a relatively small amplitude and at a high frequency, such as about 3000 RPM.

The motion by which the disc cutter 12 is driven, is such as to usually attack the rock at an angle and cause tensile failure of the rock, so that chips of rock are displaced from the rock surface under attack by the disc cutter. Here, the invention differs from rolling edge disc cutters, which apply force normal to the rock face to form lateral cracks that produce rock chips. The force required to produce a tensile failure in the rock to displace a rock chip according to the disc cutter assembly is an order of magnitude less than that required by the known rolling edge disc cutters to remove the same amount of rock, so that the device of the invention is far more efficient in respect of energy requirements.

The disc cutter 12 of the disc cutter assembly 10 preferably has a circular periphery. The disc cutter 12 includes a plurality of spaced apart cutting tips or bits 16, preferably of tungsten carbide, which are fixed to the circular periphery thereof. The periphery of the disc cutter 12 is arranged to be free to rotate relative to the oscillating movement thereof, so that the periphery can roll against the rock surface under attack. In this manner, all parts of the cutting periphery edge are progressively moved out of contact with the rock and allowed to cool, and wear is evenly distributed. Because the contact force is relatively low, the wear rate is reduced compared to the rolling edge type of cutter.

More particularly, the oscillating or eccentric movement of the disc cutter 12 can be generated in any suitable manner. In the preferred arrangement, the disc cutter 12 is mounted for rotary movement on the shaft drive section 18 driven by suitable driving means (not shown) and the disc drive section 20, as hereafter described, on which the disc cutter 12 is mounted. The axis about which the shaft drive section 18 rotates is offset from the disc drive section 20 so that the disc cutter 12 is forced to move in an eccentric manner. As shown in FIG. 1, the cross section of the disc drive section 20 shows the disc drive section 20 to be thicker below the shaft drive section 18 central axis. The central axis of the disc cutter 12 and its disc drive section 20 is offset from the axis of the shaft drive section 18 in the order of a few millimeters only. The magnitude of the offset determines the extent of the oscillating (eccentric) movement of the disc cutter 12. This eccentric movement of the disc cutter causes a jackhammer like action of the disc cutter 12 against the mineral to be mined.

In alternate constructions (not shown), the disc cutter 12 could also be caused to nutate simultaneously as it oscillates, by making the axis about which the driven section rotates angularly offset from the axis of the mounting section of the disc cutter 12, as described in Sugden U.S. Pat. No. 6,561,590.

The disc cutter 12 is mounted on the cutter assembly 10 by means of a mounting rotor 36. The mounting assembly 11 includes the housing 14 having a shaft supporting section 19. The housing 14 also supports the mounting rotor 36. The shaft supporting section 19 has a longitudinal axis which coincides with the drive shaft 13 axis. The drive shaft 13 is rotatable mounted within the shaft supporting section 19 by bearings 15 and 17, which can be of any suitable type and capacity. The bearings 15 and 17 are mounted in any suitable manner known to a person skilled in the art.

One end 21 of the shaft supporting section 19 has a flat radially extending surface 23. Attached to the outer periphery of the flat radially extending surface 23 is an annular disc retaining cap 25. The disc mounting rotor 36 includes one end 26 and it also has a flat radially extending surface 27. The one end 26 of the disc mounting rotor 36 is adjacent the one end 21 of the shaft supporting section 19, and the two ends 21 and 26 bear against one another in order to support the disc mounting rotor 36 and the cutter disc 12 for rotational movement of the cutter disc 12 relative to the shaft supporting section 19. The one end 21 of the disc mounting rotor 36 is held in place by the disc retaining cap 25, which extends over a section of the outer periphery of the disc mounting head end 21. Sufficient clearance is provided between the one end 21 of the disc mounting rotor 36 and the disc retaining cap 25 to permit the eccentric movement of the disc mounting rotor 36 and cutter disc 12 relative to the disc retaining cap 25. Lubrication ports (not shown) keep an oil film between the respective flat radially extending surfaces 23 and 27, as well as feed lubricants to the other moving parts within the cutter assembly 10. The disc cutter 12 is mounted on the mounting rotor 36 by suitable connecting means, such as threaded connectors 37. The cutting disc 12 can be removed from the disc cutter assembly 10 for replacement or reconditioning, by removing the connectors 37.

The disc cutter 12 is mounted for free rotational movement on the disc drive section 20. The disc cutter 12 is mounted by a spherical roller bearing 39 that is located by a step 40 and a wall 41 of the mounting rotor 36. The large bearing 39 is aligned directly in the load path of the disc cutter 12 and thus is subject to the majority of the radial cutter load. The various bearings employed in the cutter assembly 10 can be of any suitable kind, but preferably they are anti-friction roller bearings, and can be hydrodynamic or hydrostatic bearings.

When impacting the material to be excavated or mined, the disc cutter 12 tends to rotate as a result of the mining action. A constant rotational speed indicates proper rock fracturing is occurring, and a change in the rotational speed indicates improper rock fracturing is occurring, such as when the disc cutter 12 is being forced into the mineral too quickly, for example. In order to detect when improper mining is occurring, the cutting device 10 also includes means to determine a change in the rate of any rotation of the disc cutter. More particularly, in the preferred embodiment, a permanent magnet 40 is attached to and positioned within the mounting rotor 36 adjacent the periphery of the one end 26. And a hall sensor 42 is attached to and positioned within the one end 21 of the shaft supporting section 19 adjacent the periphery of the one end 21 so that the permanent magnet 40 passes near the hall sensor 42 as the mounting rotor 36 rotates relative to the supporting section 19. This causes a pulse to be created, and by measuring the time expired between pulses with a control 44 a change in rotation speed of the disc cutter 12 can be determined. If a change is determined, then the operation of the mining device 10 can be varied to again return the rotation speed of the disc cutter 12 to a constant value. The constant rotation speed may be any speed, or the constant rotation speed can be a predetermined preferred value. In alternate embodiments (not shown), more than one permanent magnet can used, and the direction of disc cutter rotation can be determined.

Figure 2:
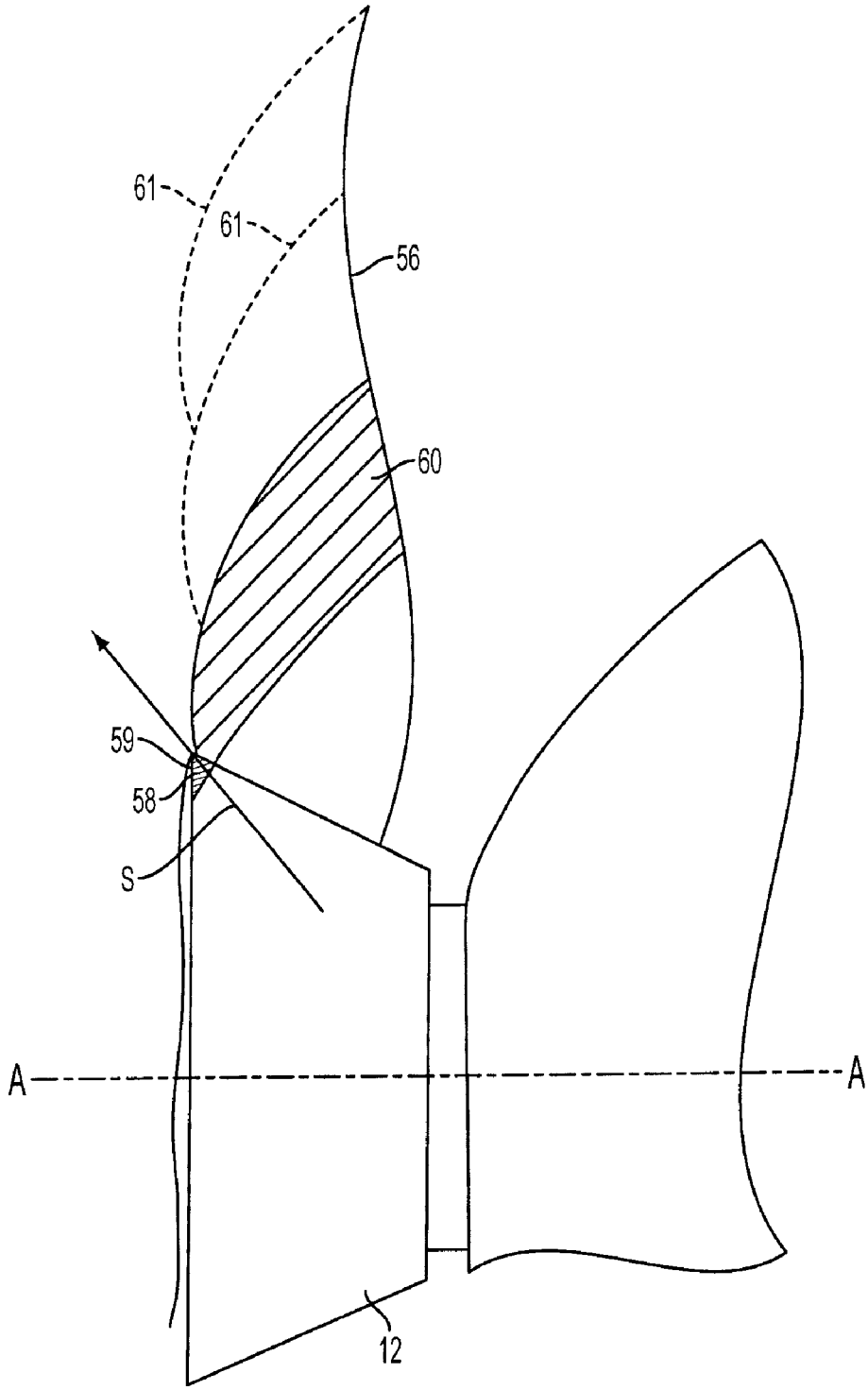
FIG. 2 is a schematic view of the action of the disc cutter assembly in excavating a rock face.

The movement of the disc cutter 12 applies an impact load to the rock surface under attack that causes tensile failure of the rock. With reference to FIG. 2, it can be seen that the motion of the disc cutter 12 brings the cutting tip or edge 58 into engagement under the oscillating movement at point 59 of the rock 56. Such oscillating movement results in travel of the disc cutter 12 in a direction substantially perpendicular to the axis AA of the mounting shaft 13. The provision of oscillating movement causes the cutting edge 58 to strike the face 59 substantially in the direction S, so that a rock chip 60 is formed in the rock as shown. Future chips are defined by the dotted lines 61. The action of the disc cutter 12 against the under face 59 is similar to that of a chisel in developing tensile stresses in a brittle material, such as rock, which is caused effectively to fail in tension. The direction S of impact of the disc cutter against the rock under face 59 is reacted through the bearing 39.

Figure 3:
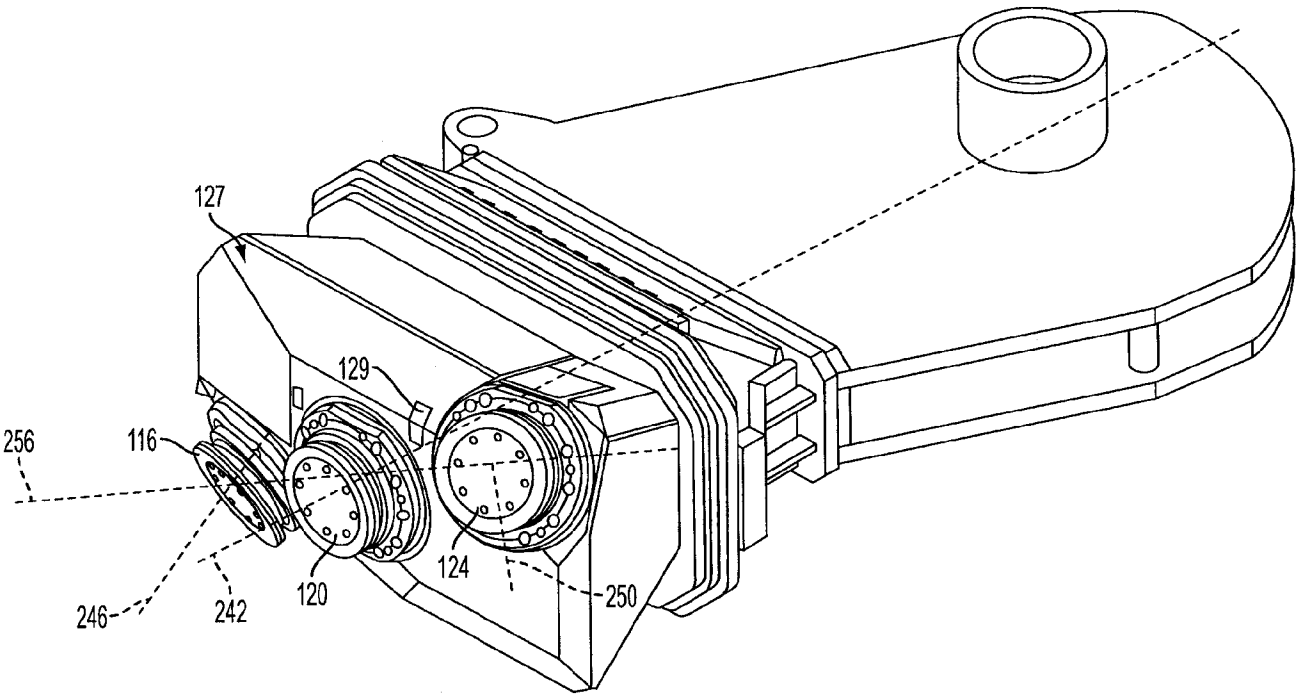
FIG. 3 is a perspective view of the cutting mechanism of this invention.
Figure 5:
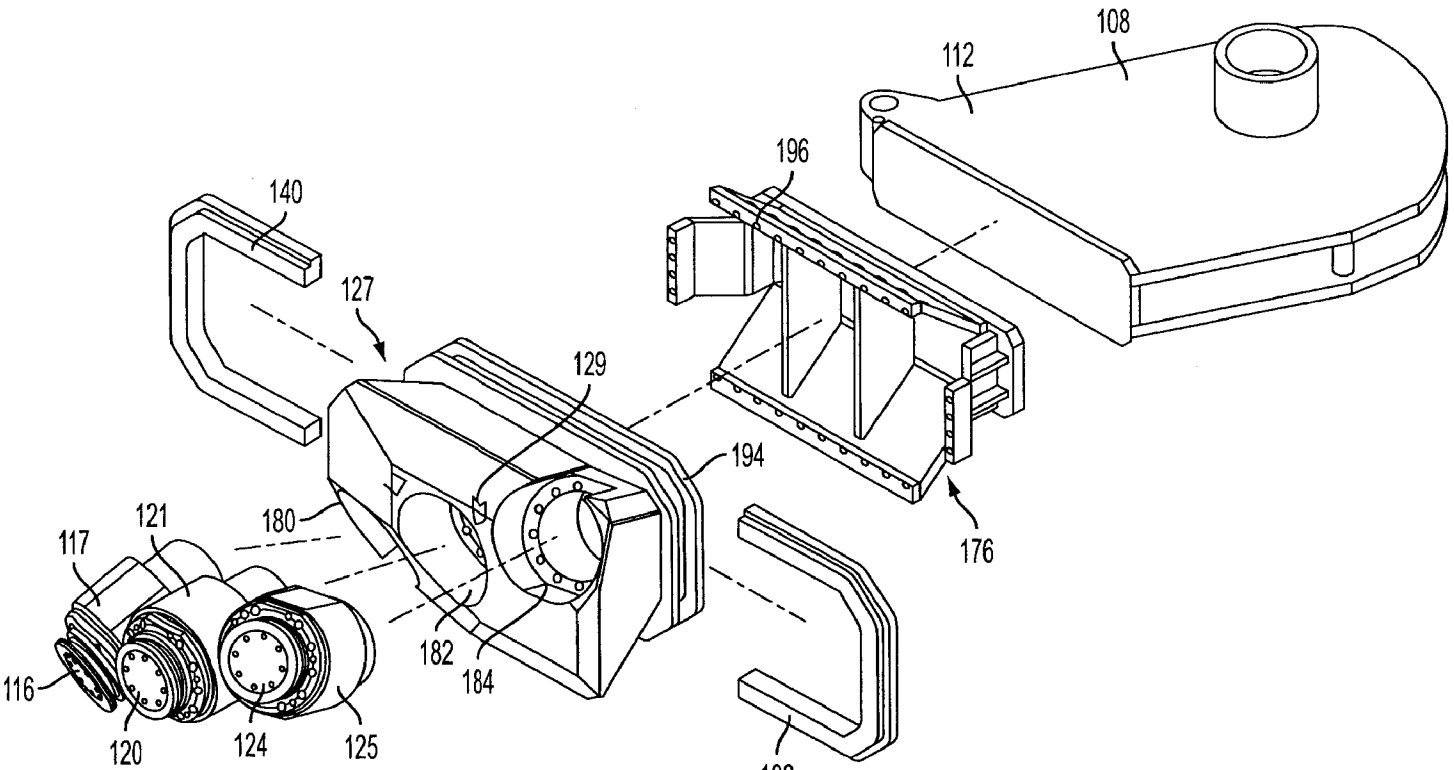
FIG. 5 is a perspective exploded view of the cutting mechanism of FIG. 3.
Figure 8:
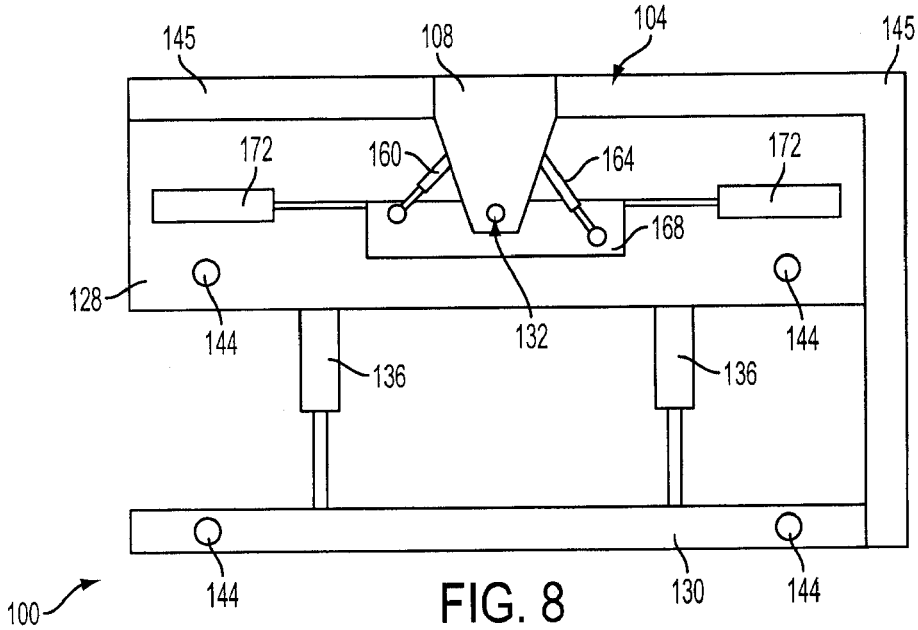
FIG. 8 is a schematic top view of the mining machine of this invention.

FIGS. 3, 5 and 8 illustrate a mining machine 100 (see FIG. 8) in accordance with the invention. The mining machine 100 includes a cutting mechanism 104 comprising an arm 108 having an arm end 112 (see FIG. 5), a first disc cutter 116 mounted on the arm end 112 via a large absorption mass 127 (see FIG. 5) and adapted to engage the material to be mined. The cutting mechanism 104 further includes a second disc cutter 120 mounted on the arm end 112 and spaced apart from the first disc cutter 116 and adapted to engage the material to be mined, and a third disc cutter 124 mounted on the arm end 112 and spaced apart from the first disc cutter 116 and the second disc cutter 120 and adapted to engage the material to be mined. More particularly, each of the disc cutters 116, 120 and 124, respectively, is part of a disc cutter assembly 117, 121 and 125 (see FIG. 5) as described above.

The disc cutters 116, 120 and 124 are mounted for movement into the rock being excavated. Thus, the mining machine 100 is mounted for example, on wheels or rails or crawlers or tracks (all not shown) and it is preferred that the mounting facility be arranged to react to the approximate average forces applied by the disc cutter, while the large absorption mass 127 (see FIG. 5) reacts the peak forces, as described below.

More particularly, as shown in FIG. 8, the cutting mechanism 104 further includes means to bring the disc cutter into the material to be mined, the means including a forward platform 128 and a rearward platform 130, pivot means 132 for mounting the arm for swinging horizontal side to side movement on the forward platform 128, and extendable and retractable means between the forward platform and the rearward platform in the form of a pair of spaced apart hydraulic cylinders 136 for moving the forward platform 128 forward (toward the material to be mined) relative to the rearward platform 140, when the rearward platform 140 is anchored, and the rearward platform 140 forward relative to the forward platform 128 when the forward platform 140 is anchored. A conveyor 145 or a vacuum system (not shown) or both can be positioned under the disc cutters and on one side of the machine 100, as shown schematically in FIG. 8, to remove dislodged material.

Figure 11:
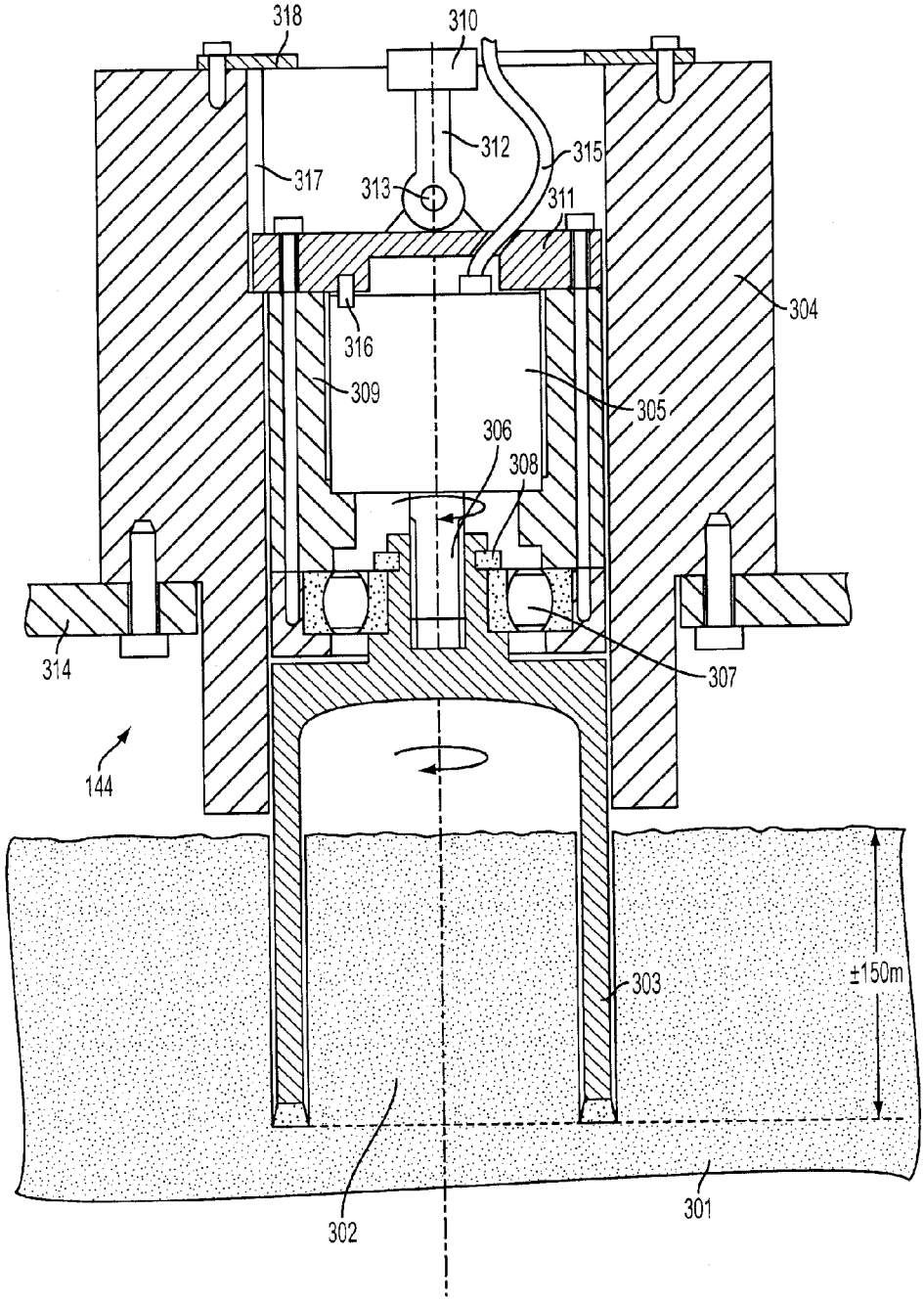
FIG. 11 is a cross-sectional view of a drill used for anchoring the mining machine shown in FIG. 8.

More particularly, the mining machine 100 includes anchoring means for anchoring the forward platform and the rearward platform, the means comprising drills 144 secured to the respective platform and that are extended into the mine floor. Additionally, hydraulic or mechanical machine mounted props (not shown) can also be used at various locations between the mine floor and the mine roof. Still more particularly, as shown in FIG. 11, the drills 144 enable the mining machine 10 to be anchored to the floor of the mine 301 by using a hollow core drill 303 to drill into the floor material perpendicular to the mean floor level to a depth of approximately 150 mm (6 inches) into the floor. The stationary drill then acts as anchor pin, with the undisturbed floor material core 302 providing additional anchor stability. The cylindrical drill carrier 304 acts as a guide while drilling and once the anchor drill 303 reaches full depth, the cylindrical drill carrier 304 also acts as a support to minimise bending moment that may be exerted on the hollow core drill 303 due to forces acting on the mining machine 10 in a direction parallel to the floor, by encasing the hollow core drill 303 with the floor material over most of its extended length.

The hollow core drill 303 is rotated by means of an electric motor 305 (although it can be a hydraulic drill in other embodiments, not shown) through a spline engagement between motor shaft 306 and the top of the hollow core drill 303. A rolling element bearing 307 in the form of a single spherical bearing enables the hollow core drill 303 to be forced into and extracted from the floor while rotating. A retaining circle clip 308 locks the hollow core drill to the inner race of rolling element bearing 307. The motor 305 is encased in a cylindrical container 309 that extends and retracts the motor 305 and attached hollow core drill 303 via the rolling element bearing 307. A hydraulic cylinder 310 extending between the respective platform and the motor 305 causes extension and retraction of the motor 305 and attached hollow core drill 303 via the cylindrical container 309 and its removable cover 311 by means of a piston rod 312 being attached to the cover 311 via a clevis and pin arrangement 310 and the cylinder 310 being attached to the respective platform. The length and attachment of cylinder and rod is arranged such that it allows a minimum extension and retraction equivalent to that of the desired maximum drilling depth plus distance between lower end of cylindrical drill carrier 304 and the floor.

The motor 305 is prevented from rotation due to reaction torque in the cylindrical container 309 by means of one or more dowel pins 316 that lock the motor to the bolted cover 311. The bolted cover 311 is prevented from rotation in the cylindrical drill carrier 304 by a tongue on the cover engaging in a matching longitudinal groove 317 in the upper section of the inner wall of the cylindrical drill carrier 304, such that it allows for extension and retraction of the motor and core drill. The length of the groove 317 is arranged to allow the full extension and retraction of the hollow core drill 303 as described above. The bottom of groove 317 and bolted cylindrical drill carrier cover 318 act as mechanical stops for motor and hollow core drill extension and retraction.

The cylindrical drill carrier 304 provides a shoulder for bolting the anchor drill 300 to the structure of the mining machine 314. A hole in the cover 311 allows entry of the power for and control 315 of motor rotation.

Each of the disc cutters 116, 120 and 124 is driven by the arm 108 into the material to be mined by swinging the arm 108 into the material to be mined by first and second hydraulic cylinders 160 and 164, respectively, connected between the arm 108 and the forward platform 128. In other embodiments (not shown), a hydraulic or electric rotary actuator can be used to rotate the arm 108, increasing the amount of arm rotation. The arm 108 is also translatable relative to the forward platform 128 by mounting the arm 108, its means for pivoting 132, and the cylinders 160 and 164 on an arm platform 168 slidable along a rail (not shown) on the forward platform 128 parallel to the material to be mined. Cylinders 172 connected between the arm platform 168 and the forward platform 128 move the arm 108 relative to the forward platform 128.

The mass of each of the disc cutters is relatively much smaller than the mass 127 provided for load absorption purposes. The load exerted on each disc cutter when it engages a rock surface under the oscillating movement is reacted or absorbed by the inertia of the large mass 127, rather than by the arm 108 or other support structure.

Figure 6:
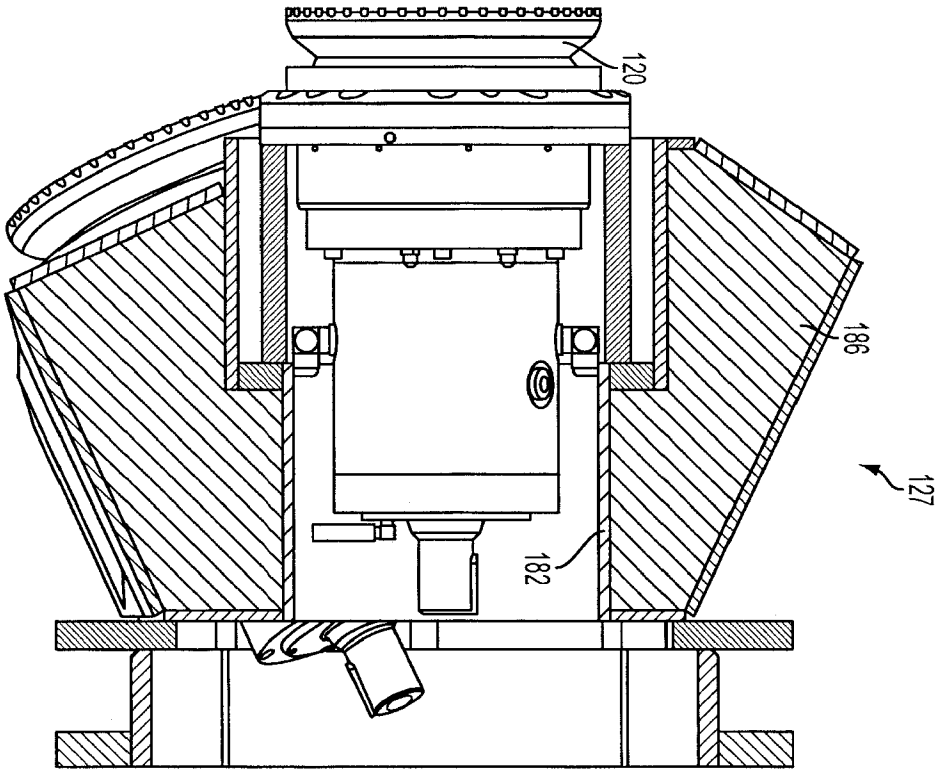
FIG. 6 is a partial cross sectional view of a cutting head section of the cutting mechanism of FIG. 3.

More particularly, as illustrated in FIGS. 3 and 5, the cutting mechanism 104 includes the arm 108, the large mass 127 in the form of a cutter head, and a bracket 176 for attaching the cutter head 127 to the arm 108. The cutter head 127 is the housing that receives the 3 disc cutter assemblies 10. Still more particularly, the cutter head includes three openings 180, 182 and 184, respectively, each of which releasably receives, in a conventional manner, one of the disc cutters 116, 120 and 124, and their respective assemblies. The cutter head interior volume surrounding the three openings is filled with a heavy material, such as pored in or precast lead 186, as shown in the cross section the cutter head 127 in FIG. 6. A water jet 129 (see FIGS. 3 and 5) is mounted adjacent the front of each disc cutter in the mineral cutting direction. By having the three eccentrically driven disc cutters share a common heavy weight, less overall weight is necessary thus making the mining machine 100 lighter and more compact. In the preferred embodiment, about 6 tons is shared among the three disc cutters, and each disc cutter is about 35 centimeters in diameter. In other embodiments, smaller or larger disc cutters can be used.

Figure 7:
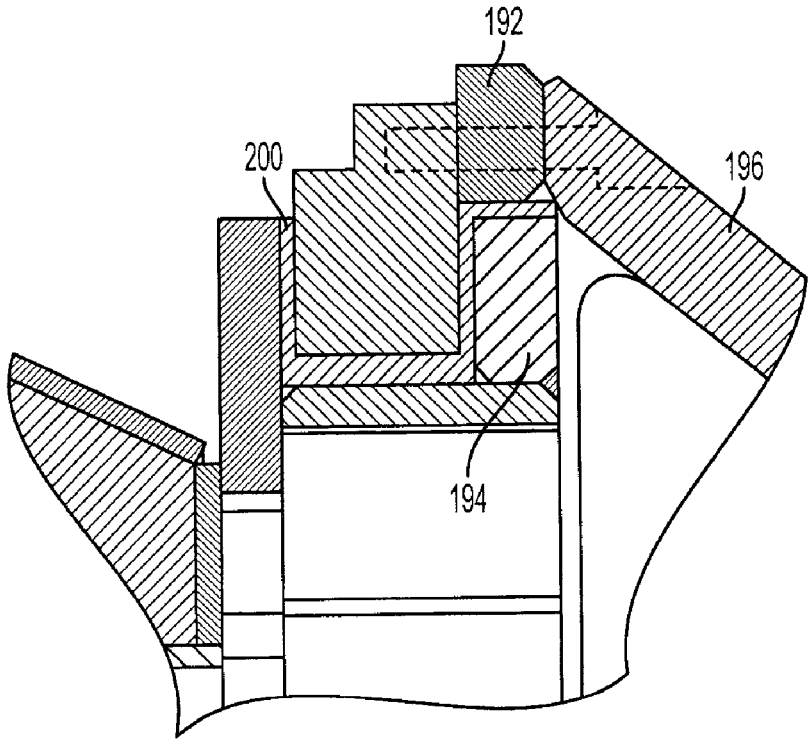
FIG. 7 is an enlarged cross-sectional view of a section of the mounting of a cutter head on an arm attachment bracket.

The bracket 176 is secured to the arm 108 in a suitable fashion (not shown), such as by welding. The bracket 176 is attached to the cutter head 127 by two U-shaped channels 190 and 192. Each channel receives a flange 194 on the cutter head 127 and a flange 196 on the bracket 176 in order to attach the cutter head 127 to the bracket 176. As illustrated in FIG. 7, a resilient sleeve 200 is placed between the cutter head 127 and the bracket 176 to isolate cutter head vibrations from the arm 108.

Figure 9:
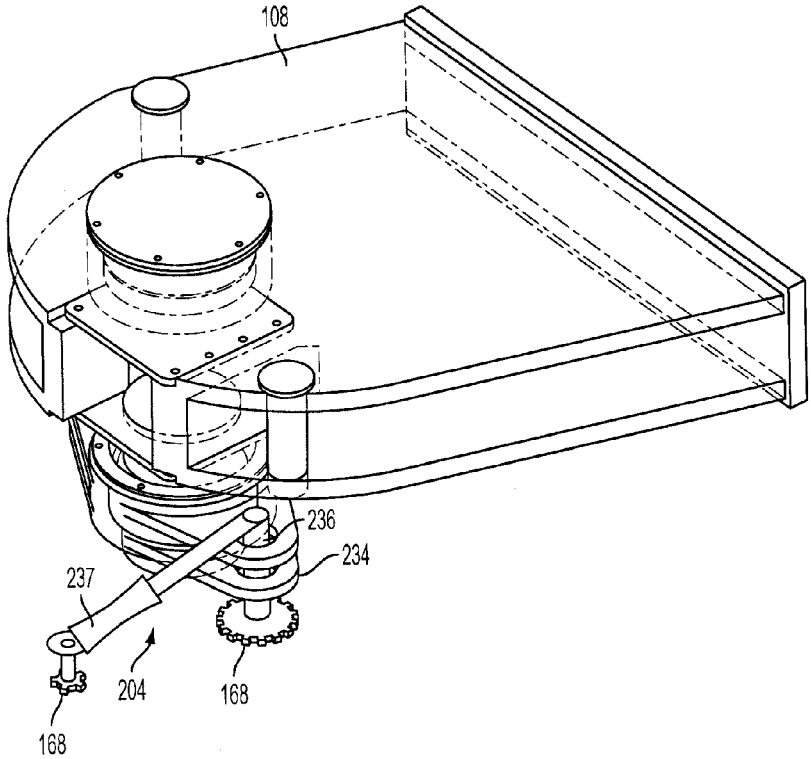
FIG. 9 is a perspective view of a mechanism for pivotally mounting an arm on the forward platform of the mining machine shown in FIG. 8.
Figure 10:
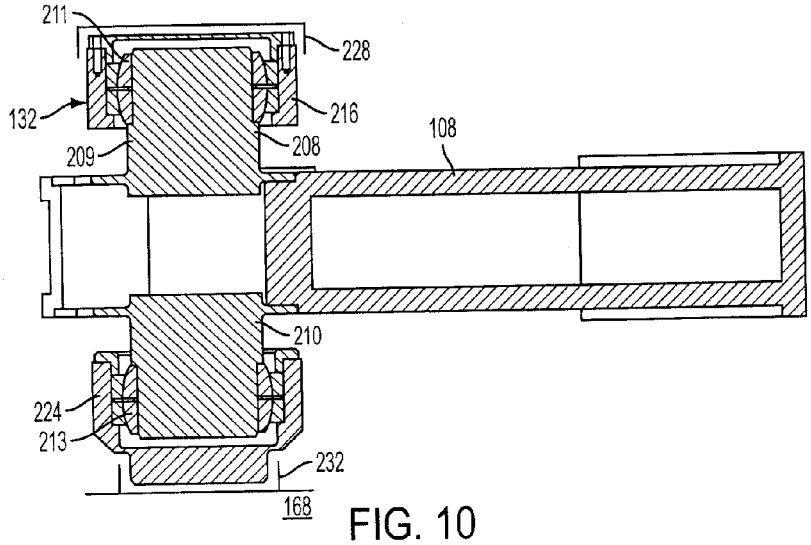
FIG. 10 is a cross-sectional view through the pivot mechanism and arm of FIG. 9.

As illustrated in FIGS. 9 and 10, the means 132 for pivot mounting of the arm 108 for swinging horizontal side to side movement on the forward platform 128 includes pivot 204 for vertical top to bottom movement of the arm 108. The pivot means 132 includes a split support pin 208 having a top pin 209 attached to the top of the arm 108 and a bottom pin 210 attached to the bottom of the arm 108. More particularly, the pivot means 204 includes an upper spherical bearing housing 216 and a lower spherical bearing housing 224. The arm 108 is mounted on the top pin 209 by an upper spherical bearing 211 between the upper spherical bearing housing 216 and the top pin 209, and the arm 108 is mounted on the bottom pin 210 by a lower spherical bearing 213 between the lower spherical bearing housing and the bottom pin 210. Each of the spherical bearing housings 216 and 224 are held stationary relative to the arm platform 168 by receptacles 228 and 232, as shown schematically in FIG. 10.

In order to accomplish the vertical up and down or top to bottom movement of the arm 108, the means 204 includes a lever 234 attached to the lower spherical bearing housing 224, a pin 236 attached to the lever 234 and pivotally attached at its base to the arm platform 168, and means for pivoting the lever in the form of a hydraulic cylinder 237 connected between the top of the pin 236 and the arm platform in order to pivot the lower spherical bearing housing 224 and thus pivot the arm 108. An identical lever and pin attached to the base platform 168 (all not shown) are attached to the opposite side of the lower spherical bearing housing 224, thereby providing a fixed pivot point for the assembly.

Figure 4:
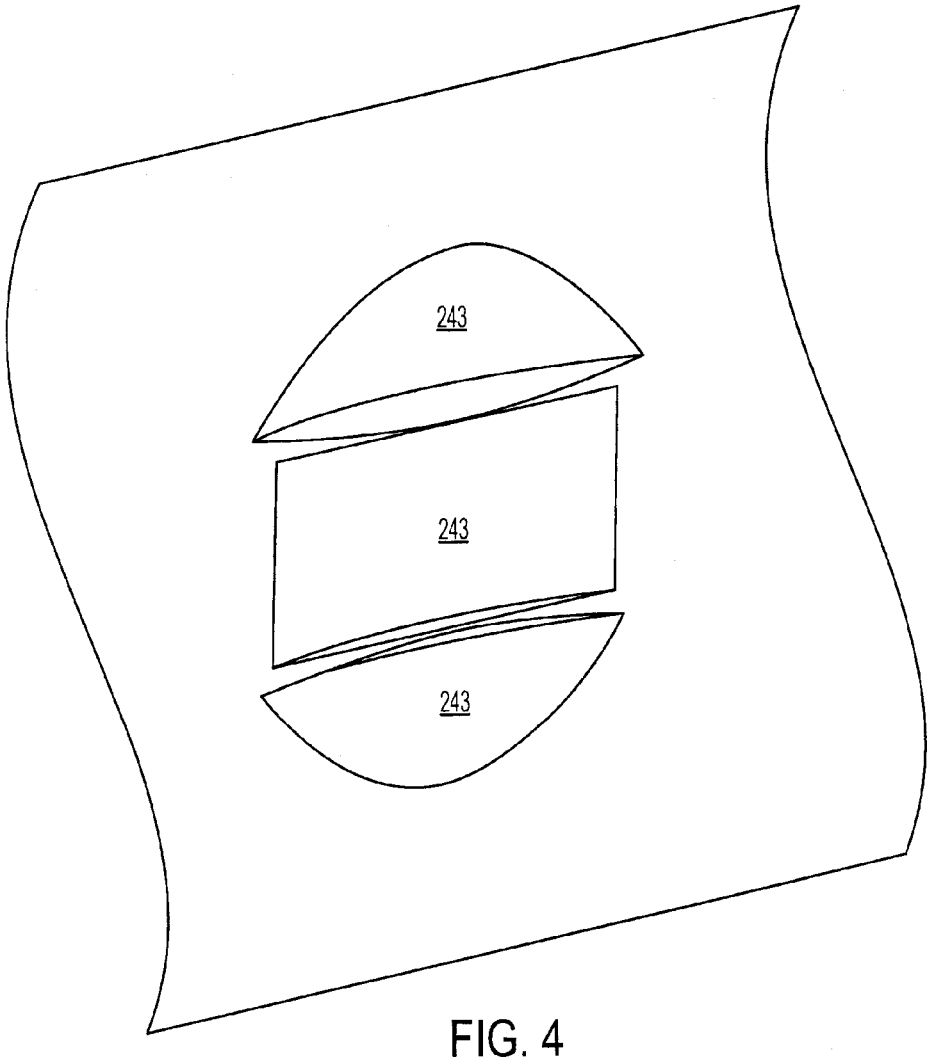
FIG. 4 is a perspective schematic view of the cutting pattern of the plurality of disc cutter assemblies in accordance with the invention.

In order to obtain even cuts 243 into the material to be mined, in a manner such as that shown in FIG. 4, the arm 108 has a longitudinal axis 242, as shown in FIG. 3, and the second disc cutter 120 is driven about an axis that is at least parallel to (or coaxial with, as in the illustrated embodiment) the arm longitudinal axis 242, and the first disc cutter 116 is driven about an axis 246 that is at an angle to the arm longitudinal axis 242, and wherein the third disc cutter 124 is mounted to rotate about an axis 250 that is at an angle to the arm longitudinal axis 242 and at an angle to the first disc cutter axis 246. The relative angles of the axes of the cutting discs is also apparent from the orientation the cutter disc assemblies shown in FIG. 5.

When a line is drawn through the three disc cutters, it defines a cutting axis 256, and this cutting axis 256 is perpendicular to the arm longitudinal axis 242, and the three disc cutters are spaced apart along the cutting axis 256.

The cutting axis 256 is offset from a line drawn perpendicular to the mine floor, so that the first or lower most disc cutter 116 will be the first to contact the mineral to be mined when the arm of FIG. 3 is swung in a clockwise direction. This results in the disc cutter 116 dislodged material falling to the mine floor. Then, as the second disc cutter 120 contacts the mineral to be mined, the space below the second disc cutter 120 has been opened by the first disc cutter 116, so it too has space below it for the dislodged minerals to fall to the mine floor. And so on for the third disc cutter 120. Thus the leading disc cutter 116 is in the lower most position, which benefits cutter life and insures that the cut product from trailing disc cutters do not get re-crushed by the leading cutters.

Further, the cutting plane of each rotating disc cutter is at angle relative to the next adjacent rotating disc cutter along the cutting axis 256. This causes each disc cutter to approach the mineral to be mined always with a ten degree angle of attack to obtain the optimum amount of dislodged material.

Still further, the disc cutters are positioned so that each disc cutter cuts equal depths into the material to be mined. This prevents unevenness in the mineral to be mined that could result in an obstruction to the mining machine 100.

The mining machine 100 is operated by advancing using the hydraulic cylinders 136 the arm 108 toward the material to be mined a first incremental distance, swinging the arm 108 to cut the material, and then advancing the arm 108 toward the material to be mined a second incremental distance, the second incremental distance being the first incremental distance. As a result, contact between the cutter head 127 and the mineral to be mined is minimized.

The cutting device of the present invention is considered to provide more cost efficient rock cutting, because the device can be built at a smaller or reduced weight compared to the weight of known rotary cutting machinery. It is envisaged that the cutting device of the invention including the support arm, can be manufactured to have a total weight of approximately 30 ton. This means that the device has the potential to be manufactured and operated at substantially reduced cost compared to the known rotary cutting machinery. The weight reduction is principally due to the enhanced rock cutting that results from the combination of oscillating movement with the undercutting disc cutter, thereby requiring a reduced cutting effort. Thus, the mining machine is subject to reduced loading and therefore requires substantially less force to effectively achieve rock fracturing. Additionally, the impact loading produced by the cutting process is relatively low and thus causes negligible damage to the adjacent surrounding rock, and thus lessens the likelihood of rock falls and reduces the amount of support necessary for excavated surfaces. Moreover, because of the overall weight of the device and the magnitude of the impact loading produced, the device can be mounted on a vehicle for movement into the excavated surface.

Various other features and advantages of the invention will be apparent from the following claims.

The invention claimed is:

1. A mining machine including a cutting mechanism comprising an arm, a substantial weight of more than a thousand pounds attached to said arm, a first disc cutter adapted to engage the material to be mined and mounted on a first disc cutter assembly for eccentrically driving the first disc cutter, the first disc cutter assembly being mounted within the substantial weight, a second disc cutter spaced apart from said first disc cutter assembly and adapted to engage the material to be mined, and mounted on a second disc cutter assembly for eccentrically driving the second disc cutter, the second disc cutter assembly being mounted within the substantial weight, a platform, means for mounting said arm for swinging side to side movement on said platform, and means to swing said arm from side to side.

2. A mining machine in accordance with claim 1 wherein said arm has an arm end, and wherein said first disc cutter is mounted on said arm end and adapted to engage the material to be mined, and wherein said second disc cutter is mounted on said arm end and spaced apart from said first disc cutter and adapted to engage the material to be mined, said two disc cutters being mounted on said arm end so that the disc cutters cut equal depths into the material to be mined.

3. A mining machine including
a cutting mechanism comprising
an arm,
means for mounting said arm for swinging horizontal side to side movement on said forward platform,
said mounting means including pivot means for vertical top to bottom movement of said arm,
said pivot means including
a split support pin, the split support pin including a top pin and a bottom pin,
an upper spherical bearing housing receiving said top pin,
a lower spherical bearing housing receiving said bottom pin,
an upper spherical bearing between said upper spherical bearing housing and said support pin, and
a lower spherical bearing between said lower spherical bearing housing and said support pin.

4. A mining machine in accordance with claim 3 wherein said pivot means includes a lever attached to said lower spherical bearing housing.

* * * * *